US008991625B2

(12) United States Patent
Bucklew et al.

(10) Patent No.: US 8,991,625 B2
(45) Date of Patent: Mar. 31, 2015

(54) ADJUSTABLE CURTAIN ROD ASSEMBLY

(75) Inventors: William Bucklew, Wilmette, IL (US); Aurelio Reyes, Palatine, IL (US); Michael Mastroianni, Crystal Lake, IL (US)

(73) Assignee: Focus Products Group International, LLC, Lincolnshire, IL (US)

( * ) Notice: Subject to any disclaimer, the term of this patent is extended or adjusted under 35 U.S.C. 154(b) by 349 days.

(21) Appl. No.: 13/462,332

(22) Filed: May 2, 2012

(65) Prior Publication Data

US 2013/0292349 A1 Nov. 7, 2013

(51) Int. Cl.

| | |
|---|---|
| ***A47H 1/02*** | (2006.01) |
| ***A47H 1/022*** | (2006.01) |
| ***A47H 1/122*** | (2006.01) |
| ***A47K 3/38*** | (2006.01) |

(52) U.S. Cl.

CPC ..... *A47H 1/022* (2013.01); *A47H 1/122* (2013.01); *A47K 3/38* (2013.01)

USPC ..... 211/105.2; 211/105.3; 248/264

(58) Field of Classification Search

CPC ..... A47H 1/10; A47H 1/102; A47H 1/104; A47H 1/14; A47H 1/142; A47H 1/144; A47H 1/02; A47H 1/022; A47H 1/03; A47H 1/04; A47H 1/06; A47H 1/08

USPC ..... 211/105.1–105.6; 248/206.5, 205.2, 248/205.3, 254, 362, 264

See application file for complete search history.

(56) References Cited

U.S. PATENT DOCUMENTS

| | | | | |
|---|---|---|---|---|
| 297,136 | A | 4/1884 | La Dow | |
| 839,959 | A | 1/1907 | Richards | |
| 912,789 | A | 2/1909 | Berbecker | |
| 1,256,849 | A | 2/1918 | Vaudreuil | |
| 1,292,969 | A | 1/1919 | Sturgis | |
| 1,487,017 | A | 3/1924 | Lilja | |
| 1,675,111 | A | 6/1928 | Kenney | |
| 1,681,010 | A | 8/1928 | Raggio | |
| 2,011,662 | A | 8/1935 | Thompson | |
| 2,131,156 | A | 9/1938 | Yardley | |
| 2,184,358 | A | 12/1939 | Moore | |
| D119,576 | S | 3/1940 | Kirsch | |
| 2,195,979 | A * | 4/1940 | Ziolkowski | 211/105.2 |

(Continued)

FOREIGN PATENT DOCUMENTS

WO WO 2006052753 5/2006

OTHER PUBLICATIONS

AU 111109 S (Lesis Kenneth Brown) May 23, 1991 [online] [retrieved May 19, 2007]. Retrieved from Australian patent database.

(Continued)

*Primary Examiner* — Korie H Chan

(74) *Attorney, Agent, or Firm* — Thompson Coburn LLP

(57) ABSTRACT

An adjustable curtain rod assembly includes an adjustable-length rod having a first end and a second end, a bracket pivotably coupled to one of the first and second ends of the rod about a pivot axis that is oriented substantially perpendicular to a longitudinal axis of the rod, a first contact pad on the bracket spaced in a lateral direction from the pivot axis for frictionally engaging a support surface, and a second contact pad on the bracket spaced in an opposite lateral direction from the pivot axis as the first mounting pad for frictionally engaging the support surface.

16 Claims, 4 Drawing Sheets

(56) References Cited

U.S. PATENT DOCUMENTS

| | | | | |
|---|---|---|---|---|
| 2,219,075 | A | 10/1940 | Le Veau | |
| 2,261,142 | A * | 11/1941 | Davis | 160/330 |
| 2,383,104 | A | 8/1945 | Allen | |
| 2,573,985 | A | 11/1951 | Porter | |
| 2,650,714 | A | 9/1953 | Brose et al. | |
| 2,698,094 | A | 12/1954 | Simpson | |
| 2,774,974 | A | 12/1956 | Zaloga | |
| 2,778,030 | A | 1/1957 | Goche | |
| 2,796,227 | A | 6/1957 | Coakley | |
| 2,878,487 | A | 3/1959 | Foote | |
| 2,890,799 | A | 6/1959 | Rosenbaum | |
| 2,902,592 | A | 9/1959 | Cole et al. | |
| 3,004,874 | A | 10/1961 | Selby | |
| 3,107,361 | A | 10/1963 | Glutting, Sr. | |
| 3,418,665 | A | 12/1968 | Long | |
| 3,521,758 | A | 7/1970 | Guilfoyle | |
| 3,557,390 | A | 1/1971 | Ruggles et al. | |
| 3,733,044 | A * | 5/1973 | Rabner | 248/313 |
| 3,737,921 | A | 6/1973 | Baumrind | |
| 3,750,818 | A | 8/1973 | Borstcher | |
| 3,872,520 | A | 3/1975 | Tyconik | |
| 3,880,394 | A | 4/1975 | Wisecarver | |
| D236,864 | S | 9/1975 | Tegner | |
| 4,043,528 | A | 8/1977 | Benoit et al. | |
| 4,117,557 | A | 10/1978 | McPeak et al. | |
| 4,229,842 | A | 10/1980 | Gilmore | |
| 4,361,914 | A | 12/1982 | Oliver | |
| 4,496,059 | A | 1/1985 | Leiter | |
| 4,659,051 | A | 4/1987 | Propp et al. | |
| 4,737,056 | A | 4/1988 | Hunt | |
| 4,754,504 | A | 7/1988 | Cellini | |
| 4,767,013 | A | 8/1988 | Bertelli | |
| 4,775,056 | A | 10/1988 | Inglis | |
| 5,022,104 | A | 6/1991 | Miller | |
| 5,031,257 | A | 7/1991 | Jeffery | |
| D318,968 | S | 8/1991 | Poulson | |
| 5,042,766 | A * | 8/1991 | Baker | 248/200.1 |
| 5,042,770 | A * | 8/1991 | Louthan | 248/311.2 |
| 5,056,753 | A | 10/1991 | Lunau et al. | |
| 5,103,531 | A | 4/1992 | Perrotta | |
| 5,174,352 | A | 12/1992 | Murray et al. | |
| 5,189,759 | A | 3/1993 | Poore | |
| 5,231,708 | A | 8/1993 | Hansen | |
| D340,376 | S | 10/1993 | Klose | |
| 5,281,063 | A | 1/1994 | Austin, III | |
| 5,287,871 | A * | 2/1994 | Trice | 135/88.05 |
| 5,328,137 | A * | 7/1994 | Miller et al. | 248/220.21 |
| 5,330,061 | A | 7/1994 | Geltz | |
| 5,402,842 | A | 4/1995 | Ruggiero | |
| 5,458,310 | A | 10/1995 | Johnson | |
| 5,513,419 | A | 5/1996 | Zinger | |
| 5,538,364 | A | 7/1996 | Huntsman | |
| D374,167 | S | 10/1996 | Scholl | |
| 5,615,721 | A | 4/1997 | Winter | |
| 5,662,297 | A | 9/1997 | Christensen et al. | |
| D393,390 | S | 4/1998 | Gottwald | |
| 5,794,281 | A | 8/1998 | Shearon | |
| D397,928 | S | 9/1998 | Wise | |
| 5,803,782 | A | 9/1998 | Selton | |
| 5,894,610 | A | 4/1999 | Winter | |
| 5,941,527 | A | 8/1999 | Selton | |
| 5,979,854 | A * | 11/1999 | Lundgren et al. | 248/354.3 |
| 6,024,331 | A | 2/2000 | Bischoff et al. | |
| 6,032,306 | A | 3/2000 | Gummin | |
| D426,142 | S | 6/2000 | Moore | |
| 6,138,970 | A | 10/2000 | Sohrt et al. | |
| 6,154,894 | A | 12/2000 | Alexander et al. | |
| 6,216,287 | B1 | 4/2001 | Wise | |
| 6,263,523 | B1 | 7/2001 | Moore | |
| 6,296,287 | B1 | 10/2001 | Kinbara et al. | |
| D462,425 | S * | 9/2002 | Tse | D23/304 |
| D466,351 | S | 12/2002 | Tai | |
| 6,688,479 | B2 | 2/2004 | Nei | |
| 6,694,543 | B2 | 2/2004 | Moore | |
| D499,954 | S | 12/2004 | Brushaber | |
| 6,857,140 | B1 | 2/2005 | Broudy | |
| 6,857,247 | B2 | 2/2005 | Adams | |
| D542,897 | S | 5/2007 | Harwanko | |
| 7,222,376 | B1 | 5/2007 | Gunning | |
| D552,455 | S | 10/2007 | Moore | |
| D557,590 | S | 12/2007 | Moore et al. | |
| D565,395 | S | 4/2008 | Moore et al. | |
| D565,710 | S | 4/2008 | Cropelli | |
| D567,637 | S | 4/2008 | Moore | |
| D578,521 | S * | 10/2008 | Sergi et al. | D14/238 |
| D586,647 | S | 2/2009 | Didehvar | |
| D590,698 | S | 4/2009 | Moore et al. | |
| 7,512,997 | B2 * | 4/2009 | Dewees | 4/610 |
| 7,708,317 | B2 | 5/2010 | Leblanc | |
| D631,734 | S | 2/2011 | Fernandez et al. | |
| D633,780 | S | 3/2011 | Barrese | |
| D634,609 | S | 3/2011 | Bauer | |
| D648,619 | S | 11/2011 | Lowe | |
| 8,056,873 | B1 | 11/2011 | Hanley et al. | |
| 8,069,507 | B2 | 12/2011 | Didehvar et al. | |
| 2002/0014568 | A1 | 2/2002 | Faucher et al. | |
| 2004/0107493 | A1 | 6/2004 | Orpilla | |
| 2004/0237701 | A1 | 12/2004 | Hilss et al. | |
| 2005/0268394 | A1 * | 12/2005 | Monk et al. | 4/558 |
| 2006/0070177 | A1 | 4/2006 | Bathurst et al. | |
| 2006/0096023 | A1 | 5/2006 | Dewees | |
| 2007/0006377 | A1 | 1/2007 | Moore | |
| 2007/0006378 | A1 | 1/2007 | Moore | |
| 2007/0174956 | A1 | 8/2007 | Heaslip | |
| 2008/0115265 | A1 | 5/2008 | Heaslip | |
| 2008/0282464 | A1 | 11/2008 | Bauer | |
| 2011/0079691 | A1 * | 4/2011 | Gorsuch et al. | 248/216.1 |

OTHER PUBLICATIONS

AU 136336 S (Council of the City of Sydney) Feb. 3, 1999 [online] [retrieved May 19, 2007]. Retrieved from Australian patent database.
International Search Report/Written Opinion for PCT/US05/40016, dated Mar. 30, 2007.

* cited by examiner

ADJUSTABLE CURTAIN ROD ASSEMBLY

FIELD OF THE INVENTION

The present invention relates to adjustable curtain rods, and more particularly to adjustable curtain rods for shower curtains.

BACKGROUND OF THE INVENTION

Adjustable shower curtain rods are known. A common adjustable rod, sometimes referred to as a tension rod, takes the form of a telescoping, two-piece rod. The two rod halves can be rotated relative to one another to shorten or lengthen the rod to fit the shower or bath enclosure. Such rods are typically supported by respective brackets fastened to opposed walls of the shower or bath enclosure.

SUMMARY OF THE INVENTION

The present invention provides, in one aspect, an adjustable curtain rod assembly including an adjustable-length rod having a first end and a second end, a bracket pivotably coupled to one of the first and second ends of the rod about a pivot axis that is oriented substantially perpendicular to a longitudinal axis of the rod, a first contact pad on the bracket spaced in a lateral direction from the pivot axis for frictionally engaging a support surface, and a second contact pad on the bracket spaced in an opposite lateral direction from the pivot axis as the first mounting pad for frictionally engaging the support surface.

The present invention provides, in another aspect, an adjustable curtain rod assembly including an adjustable-length rod having a first end and a second end, a bracket pivotably coupled to each of the first and second ends of the rod about respective pivot axes that are oriented substantially perpendicular to a longitudinal axis of the rod, a first contact pad on each bracket spaced in a lateral direction from the pivot axis of the respective bracket for frictionally engaging a support surface, a second contact pad on each bracket spaced in an opposite lateral direction from the pivot axis of the respective bracket as the first mounting pad for frictionally engaging the support surface, and a third contact pad on each bracket aligned with the pivot axis of the respective bracket for frictionally engaging the support surface.

The present invention provides, in yet another aspect, an adjustable curtain rod assembly including an adjustable-length rod having a first end and a second end, defining therebetween a longitudinal axis, a T-shaped bracket coupled to one of the first and second ends of the rod, a first contact pad on the bracket spaced in a lateral direction from the longitudinal axis for frictionally engaging a support surface, and a second contact pad on the bracket spaced in an opposite lateral direction from the longitudinal axis as the first contact pad for frictionally engaging the support surface.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
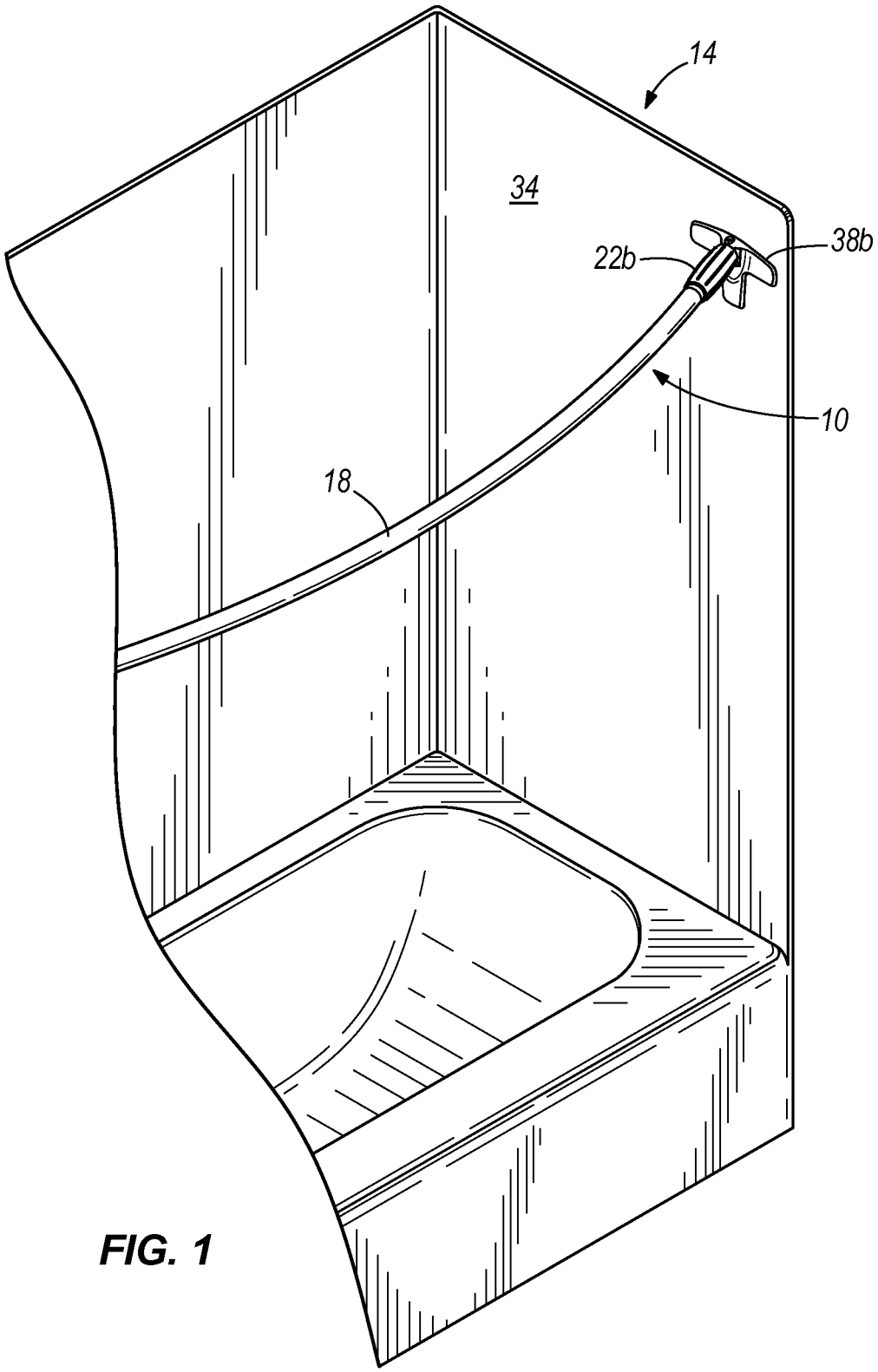
FIG. 1 is a front perspective view of an adjustable curtain rod assembly of the invention mounted in a shower enclosure.

FIG. 1 illustrates an adjustable curtain rod assembly 10 installed on a shower or bath enclosure 14 such that a curtain supported by the rod assembly 10 encloses the shower or bath to substantially contain water, to provide privacy to the occupant, and to provide a decorative feature to the bathroom. However, it is to be understood that the rod assembly 10 need not be used exclusively for bath and shower applications, but can be used for other applications utilizing a curtain or support rod (e.g., window treatments, dividers, vestibules, etc.).

Figure 2:
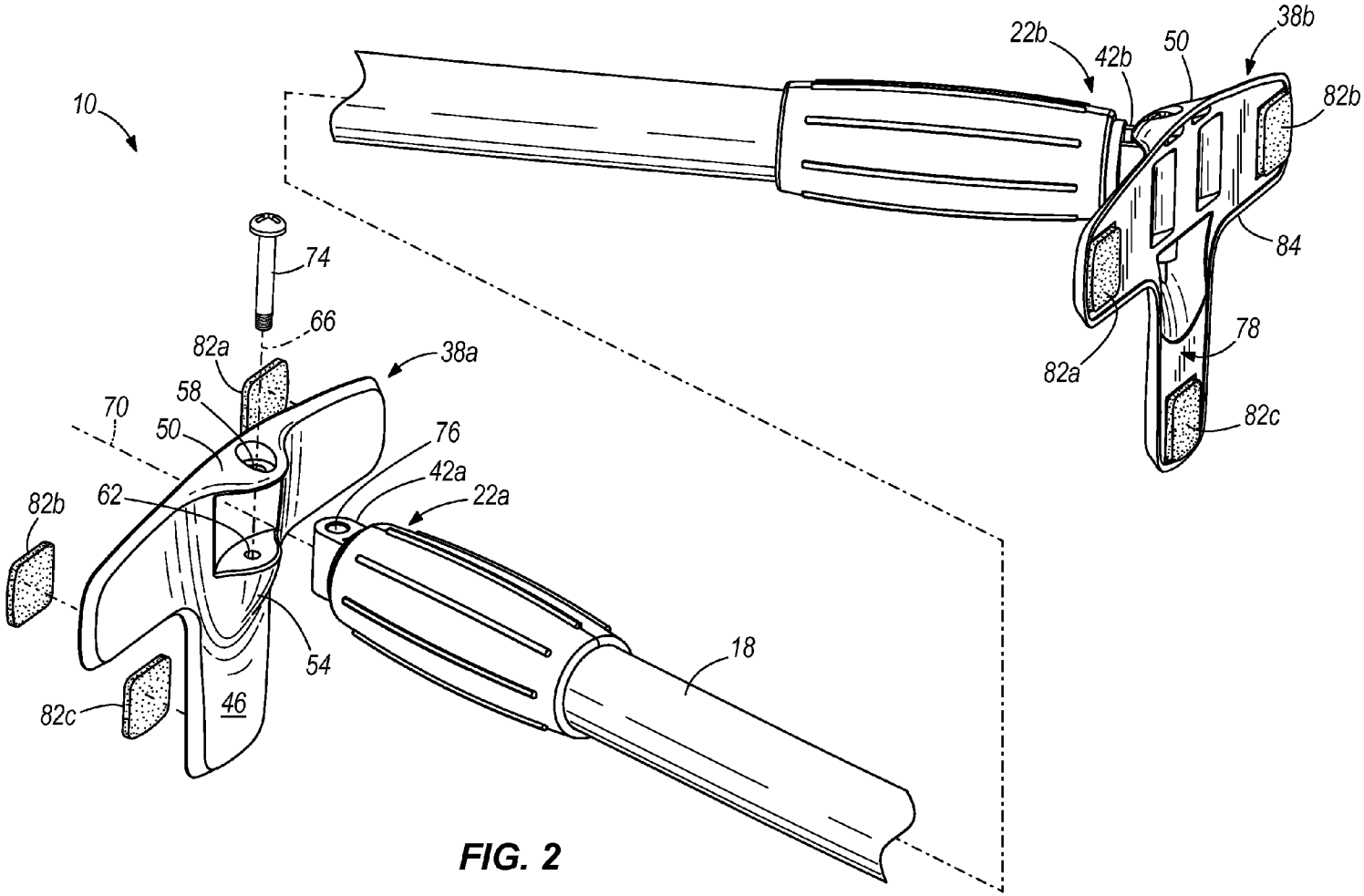
FIG. 2 is a partially exploded, perspective view of the adjustable curtain rod assembly of FIG. 1.

With reference to FIGS. 1 and 2, the rod assembly 10 includes an arcuate or curved rod 18 having opposed first and second ends 22*a*, 22*b*. Alternatively, the rod 18 may have a substantially straight configuration when installed in a shower or bath enclosure 14. In the illustrated embodiment, the rod 18 can be made from any suitable material and may include a single integral piece or multiple pieces incorporated as a unit. The rod 18 may further include an adjustment mechanism for adjusting an overall length of the rod assembly 10 in order to fit a specific mounting dimension for an application of use. Such an adjustment mechanism is described in U.S. Patent Application Publication No. 2011/0031198 filed on Aug. 5, 2009, the entire content of which is incorporated herein by reference. For example, for standardized shower and bath enclosure dimensions, the rod assembly 10 can be nominally sized to have a length generally appropriate for a standard dimension. The adjustment mechanism (s) of the rod 18 would provide the final adjustability so that the rod assembly 10 can be supported by opposing support surfaces 34 of the shower and/or bath enclosure 14 (only one of which is shown in FIG. 1) via pressure created by extending the length of the rod assembly 10 between the support surfaces 34. Such pressure-mounted rod assemblies are often referred to as tension rods.

Figure 5:
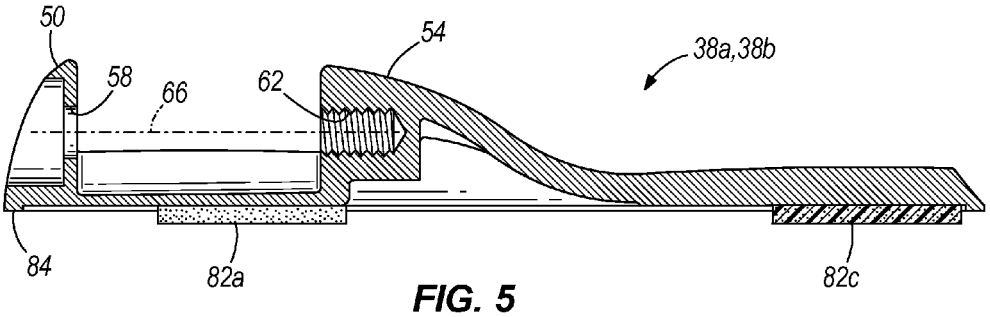
FIG. 5 is a cross-sectional view through the bracket of FIG. 4 along line 5-5.

Referring now to FIG. 2, the rod assembly 10 includes first and second brackets 38*a*, 38*b* coupled to the first and second ends 22*a*, 22*b* of the rod 18, respectively. Particularly, the first end 22*a* of the rod 18 includes a first fastener receiving member 42*a* pivotably coupled to the first bracket 38*a*, and the second end 22*b* of the rod 18 includes a second fastener receiving member 42*b* pivotably coupled to the second bracket 38*b*. The front surface 46 of each of the brackets 38*a*, 38*b* includes a first, upper-most ear 50 and a second, lower-most ear 54 between which the respective fastener receiving members 42*a*, 42*b* are supported. In each of the brackets 38*a*, 38*b*, the upper-most ear 50 includes a through-bore 58 and the lower-most ear 54 includes a threaded bore 62 in alignment with the through-bore 58 to define a pivot axis 66 (see also FIG. 5). As shown in FIG. 2, the pivot axis 66 of each of the brackets 38*a*, 38*b* is substantially perpendicular to a longitudinal axis 70 of the rod 18 such that the rod 18 is generally pivotable relative to each of the brackets 38*a*, 38*b* in a horizontal plane when installed in a shower or bath enclosure 14.

The rod assembly 10 also includes respective pins 74 oriented along the pivot axes 66 of the first and second brackets 38*a*, 38*b*, and received within the through-bore 58 and threaded bore 62 of each of the brackets 38*a*, 38*b*, and within a through-bore 76 of the respective first and second fastener receiving members 42*a*, 42*b* (FIG. 2). In the illustrated embodiment of the rod assembly 10, the pins 74 are configured as threaded fasteners that are anchored to the threaded bores 62 of the respective brackets 38*a*, 38*b*. Alternatively, different structural arrangements may be employed for securing the rod 18 to the brackets 38*a*, 38*b*. For example, a fixed connection (i.e., one having zero degrees of freedom) may be utilized between the rod 18 and each of the brackets 38*a*, 38*b*. The brackets 38*a*, 38*b* can be made from aluminum, stainless steel, zinc, plastic, or other suitable materials.

Figure 3:
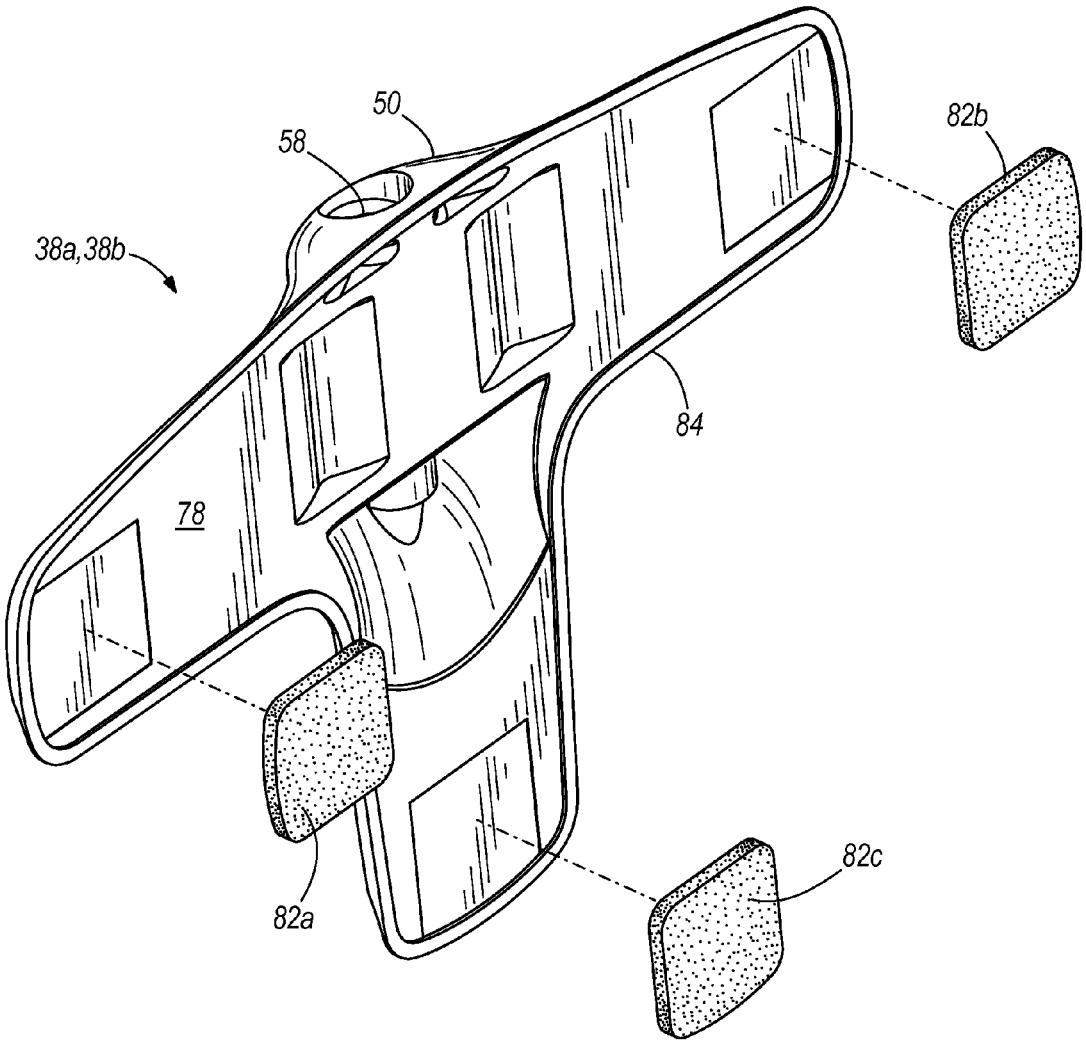
FIG. 3 is an exploded, rear perspective view of a bracket of the adjustable curtain rod assembly of FIG. 1.
Figure 4:
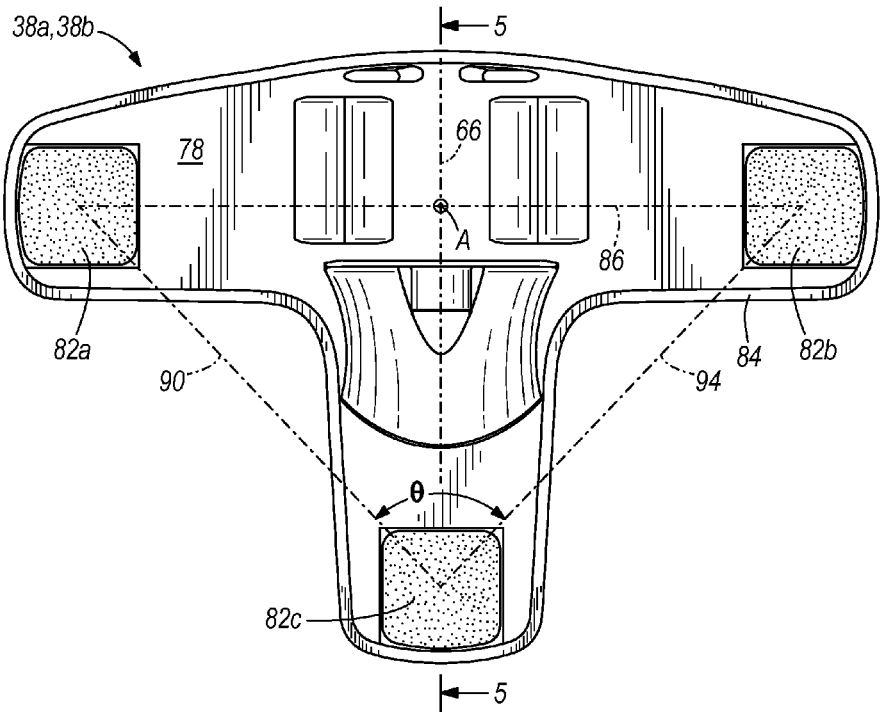
FIG. 4 is a rear view of the bracket of FIG. 3.

With reference to FIG. 1, the brackets 38*a*, 38*b* (with only the right-side bracket 38*b* being shown) are configured to be frictionally mounted against the support surfaces 34. The relatively large footprint of the brackets 38*a*, 38*b* facilitates distribution of the compressive loading exerted by the rod 18 over a large portion of the support surfaces 34, thereby minimizing the risk of damage to the support surfaces 34 during installation of the rod assembly 10. With reference to FIGS. 2-4, each of the brackets 38*a*, 38*b* includes first, second, and third elastomeric contact pads 82*a*, 82*b*, 82*c* attached to the rear surface 78 (e.g., with an adhesive, etc.) and that engages the support surfaces 34. In the illustrated embodiment of the rod assembly 10, the contact pads 82*a*, 82*b*, 82*c* are made of rubber. Alternatively, the contact pads 82*a*, 82*b*, 82*c* may be made of any of a number of different elastomeric or other suitable materials. For example, the contact pads 82*a*, 82*b*, 82*c* may include an adhesive to facilitate attachment to the support surfaces 34, or a friction or non-slip outer surface to enhance the grip that the contact pads 82*a*, 82*b*, 82*c* may exert on the support surfaces 34.

With reference to FIG. 4, the first and second contact pads 82*a*, 82*b* are noncontiguous and are generally evenly spaced on laterally opposite sides of the pivot axis 66 of each of the brackets 38*a*, 38*b*. The third contact pad 82*c* is noncontiguous with the first and second contact pads 82*a*, 82*b* and is generally aligned with the pivot axis 66 of each of the brackets 38*a*, 38*b*. In addition, the third contact pad 82*c* is positioned below the lower-most ear 54 when the brackets 38*a*, 38*b* are oriented in their mounted position. The brackets 38*a*, 38*b* are configured having a T-shape to accommodate this arrangement of the contact pads 82*a*, 82*b*, 82*c*, as shown in FIGS. 2-4. Each of the brackets 38*a*, 38*b* also includes an outer peripheral lip 84 spaced from the rear surface 78 and at least partially defining the T-shape of the brackets 38*a*, 38*b* (see also FIGS. 2, 3, and 5). However, in some embodiments of the rod assembly 10, the contact pad 82*c* may be omitted from each of the brackets 38*a*, 38*a* such that the brackets 38*a*, 38*b* may assume a different configuration. In other embodiments of the rod assembly 10, the contact pads 82*a*, 82*b*, 82*c* may be configured as portions of a single contiguous contact pad.

With reference to FIG. 4, a first imaginary line 86 connects the centers or midpoints of the first and second contact pads 82*a*, 82*b*, and passes between the ears 50, 54, but closer to the lower-most ear 54. When the brackets 38*a*, 38*b* are installed in their mounted positions on the opposed support surfaces 34, the imaginary line 86 is oriented substantially horizontal to position the contact pads 82*a*, 82*b* on opposite lateral sides of the pivot axis 66. A second imaginary line 90 connects the centers or midpoints of the first and third contact pads 82*a*, 82*c*, and a third imaginary line 94 connects the centers or midpoints of the second and third contact pads 82*b*, 82*c*. The included angle θ between the second and third imaginary lines 90, 94 is approximately 90 degrees, although other angles are possible depending upon the configuration of the contact pads 82*a*, 82*b*, 82*c* on the brackets 38*a*, 38*b*.

When the rod assembly 10 is installed between the opposed support surfaces 34, the rod 18 is adjusted to a length (or, elastically bent into a curved shape) for exerting a normal force against each of the support surfaces 34 through the contact pads 82*a*, 82*b*, 82*c* of each bracket 38*a*, 38*b* to develop frictional forces between the support surfaces 34 and the contact pads 82*a*, 82*b*, 82*c*. The sum of the frictional forces between the support surfaces 34 and the contact pads 82*a*, 82*b*, 82*c* resists or counteracts the weight and any moment about an axis A oriented normal to the page containing FIG. 4 that is produced by the rod 18 and any attached curtain. This is especially significant with curved or arcuate rods 18 because the weight of the curtain suspended from the rod 18, when represented as a single point mass, may be offset from the axis A as a result of the curvature of the rod 18. The larger the curvature of the rod 18, the farther the center of mass of the curtain is moved from the axis A. Particularly, the vertical span of each of the brackets 38*a*, 38*b*, with the attached contact pad 82*c*, provides stability to the installed rod assembly 10 while the horizontal span of each of the brackets 38*a*, 38*b*, with the attached contact pads 82*a*, 82*b*, resists or counteracts the moment about axis A caused by the offset weight of the rod 18 with an attached curtain. The brackets 38*a*, 38*b* support the rod 18 with an attached curtain without the need for more permanent conventional fasteners (e.g., screws).

The rod assembly 10 may be installed into a shower and/or bath enclosure 14 after the ends 22*a*, 22*b* of the rod 18 are attached to the respective brackets 38*a*, 38*b*. To attach each bracket 38*a*, 38*b*, the through-bore 76 in the respective fastener receiving members 42*a*, 42*b* is aligned with the pivot axis 66 of each of the brackets 38*a*, 38*b* (FIG. 2). Then, for each bracket 38*a*, 38*b*, the pin 74 is inserted through the respective through-bores 58, 76 in the upper-most ear 50 and the fastener receiving member 42*a*, 42*b*. The pin 74 is then received by the threaded bore 62 in the lower-most ear 54 and anchored therein by threaded engagement. This coupling arrangement provides the rod 18 with a rotational degree of freedom, with respect to each of the brackets 38*a*, 38*b*, about the pivot axis 66. Next, should the rod 18 include an adjustment mechanism for varying its length (i.e., like that disclosed in U.S. Patent Application Publication No. 2011/0031198), the length of the rod 18 is then adjusted to position the brackets 38*a*, 38*b* between the opposed support surfaces 34 in the shower and/or bath enclosure 14. To fix the rod assembly 10 in place, the adjustment mechanism is manipulated to thereby lengthen the rod 18 until it exerts a compressive load on each of the support surfaces 34, thereby allowing the contact pads 82*a*, 82*b*, 82*c* to develop a frictional force against the opposed support surfaces 34.

If a fixed-length rod is used (i.e., without such a length adjustment mechanism as described in published U.S. Patent Application No. 2011/0031198), the rod assembly 10 may be secured to the opposed support surfaces 34 by exerting a buckling force on the rod 18 to elastically bend it, positioning the rod assembly 10 between the support surfaces 34, and then releasing the buckling force on the rod 18 when the brackets 38*a*, 38*b* are properly positioned. As the rod 18 elastically recovers, a compressive force is exerted on the support surfaces 34 by the respective brackets 38*a*, 38*b* in a similar manner as described above to develop frictional forces against the support surfaces 34.

These frictional forces resist the weight of the rod assembly 10 and any attached curtain, maintaining the rod assembly 10 fixed in place without the need for more permanent conventional fasteners. The combined weight of the rod assembly 10 and the attached curtain also applies a moment on each of the brackets 38*a*, 38*b*. The T-shaped arrangement of the contact pads 82*a*, 82*b*, 82*c* provides the friction forces developed by the contact pads 82*a*, 82*b*, 82*c* with extended moment arms (especially the spaced contact pads 82*a*, 82*b*), thereby improving the bracket's stability and capability of resisting or cancelling the moment (about axis A in FIG. 4) otherwise caused by the combined weight of the rod assembly 10 and the attached curtain.

Various features of the invention are set forth in the following claims.

What is claimed is:

1. An adjustable curtain rod assembly comprising:

an adjustable-length rod having a first end and a second end;

a bracket pivotably coupled to each of the first and second ends of the rod about a pivot axis that is oriented substantially perpendicular to a longitudinal axis of the rod;

each bracket having:

a first contact pad on the bracket spaced in a lateral direction from the pivot axis for frictionally engaging a support surface; and a second contact pad on the bracket spaced in an opposite lateral direction from the pivot axis as the first mounting pad for frictionally engaging the support surface; and a third contact pad on the bracket aligned with the pivot axis for frictionally engaging the support surface;

wherein each bracket defines a "T" shape for accommodating the first, second, and third contact pads;

wherein the support surface is at least partially defined by opposed walls;

wherein the rod is operable to exert a normal force against each of the walls through the contact pads of each of the first and second brackets to develop a frictional force between the walls and the contact pads.

2. The adjustable curtain rod assembly of claim 1, wherein the first, second, and third contact pads are noncontiguous relative to each other.

3. The adjustable curtain rod assembly of claim 1, wherein each of the first and second contact pads includes at least one of an elastomeric material and a non-slip outer surface.

4. The adjustable curtain rod assembly of claim 1, wherein the bracket includes spaced ears between which the pivot axis is defined.

5. The adjustable curtain rod assembly of claim 4, further comprising a pin supported by the spaced ears, wherein the pin pivotably couples the one of the first and second ends of the rod to the bracket.

6. The adjustable curtain rod assembly of claim 5, wherein the pin is configured as a threaded fastener, and wherein at least one of the ears includes a threaded bore in which the threaded fastener is received.

7. The adjustable curtain rod assembly of claim 5, wherein the one of the first and second ends of the rod includes a bore through which the pin is received.

8. The adjustable curtain rod assembly of claim 4, wherein the first and second contact pads are connected by an imaginary line passing through the center of each of the contact pads, and wherein the imaginary line passes between the spaced ears.

9. The adjustable curtain rod assembly of claim 8, wherein the imaginary line is disposed closer to a lower-most of the spaced ears than an upper-most of the spaced ears.

10. The adjustable curtain rod assembly of claim 9, wherein the first and third contact pads are connected by a second imaginary line passing through the center of each of the first and third contact pads, wherein the second and third contact pads are connected by a third imaginary line passing through the center of each of the second and third contact pads, and wherein an included angle between the second and third imaginary lines is about 90 degrees.

11. The adjustable curtain rod assembly of claim 1, wherein the first and second brackets are secured to the opposed walls without using fasteners anchored to the walls.

12. The adjustable curtain rod assembly of claim 1, wherein the rod is an arcuate rod.

13. An adjustable curtain rod assembly comprising:

an adjustable-length rod having a first end and a second end;

a bracket pivotably coupled to each of the first and second ends of the rod about respective pivot axes that are oriented substantially perpendicular to a longitudinal axis of the rod;

a first contact pad on each bracket spaced in a lateral direction from the pivot axis of the respective bracket for frictionally engaging a support surface;

a second contact pad on each bracket spaced in an opposite lateral direction from the pivot axis of the respective bracket as the first mounting pad for frictionally engaging the support surface; and a third contact pad on each bracket aligned with the pivot axis of the respective bracket for frictionally engaging the support surface.

14. The adjustable curtain rod assembly of claim 13, wherein the bracket defines a "T" shape for accommodating the first, second, and third contact pads.

15. The adjustable curtain rod assembly of claim 13, wherein the first, second, and third contact pads are noncontiguous relative to each other.

16. The adjustable curtain rod assembly of claim 13, wherein the rod is an arcuate rod.

* * * * *